United States Patent [19]

Nakamura

[11] Patent Number: 4,775,127

[45] Date of Patent: Oct. 4, 1988

[54] DEVICE FOR FIXING RAIL FOR HANGING EXHIBITS

[76] Inventor: Masazo Nakamura, 10-12, Shimanouchi 1-chome, Minami-ku, Osaka, Japan

[21] Appl. No.: 76,190

[22] Filed: Jul. 21, 1987

[30] Foreign Application Priority Data

Jun. 2, 1987 [JP] Japan ..... 62-86054

[51] Int. Cl.[4] ..... A47G 1/16

[52] U.S. Cl. ..... 248/489; 403/354; 403/375; 49/409; 248/476; 248/221.4; 248/223.4; 248/339; 16/94 R

[58] Field of Search ..... 248/476, 489, 490, 497, 248/221.4, 223.4, 225.1, 220.2, 223.3, 224.1, 224.2, 225.2, 231.8, 339; 52/273; 403/354, 360, 375; 16/94 R, 94 D; 49/109–112, 409

[56] References Cited

U.S. PATENT DOCUMENTS

| | | | |
|---|---|---|---|
| 3,848,380 | 11/1974 | Assael | 52/273 X |
| 3,949,960 | 4/1976 | McKee | 248/220.2 |
| 4,133,507 | 1/1979 | Chervenak | 248/275.2 |
| 4,326,689 | 4/1982 | Edel et al. | 248/221.4 |

FOREIGN PATENT DOCUMENTS

| | | | |
|---|---|---|---|
| 1297301 | 6/1969 | Fed. Rep. of Germany | 16/94 D |
| 2230550 | 1/1974 | Fed. Rep. of Germany | 248/489 |
| 2248199 | 3/1974 | Fed. Rep. of Germany | 16/94 R |
| 655990 | 5/1986 | Switzerland | 248/489 |

*Primary Examiner*—Alvin C. Chin-Shue

*Attorney, Agent, or Firm*—Wenderoth, Lind & Ponack

[57] ABSTRACT

A member for mounting a suspension rail for hanging exhibits such as paintings is adapted to be secured to a wall near the ceiling by screws. The member has a base plate and a supporting projection extending horizontally from the base plate. The base plate has a pair of inclined surfaces at both sides of the supporting projection. The projection is formed with a horizontal slit to form an elastic piece to facilitate the engagement of the suspension rail.

1 Claim, 1 Drawing Sheet

(PRIOR ART)

DEVICE FOR FIXING RAIL FOR HANGING EXHIBITS

BACKGROUND OF THE INVENTION

The present invention relates to a device for mounting a rail adapted to hang exhibits.

For hanging a great number of various kinds of exhibits (e.g. paintings), a known arrangement comprises a suspension rail secured to the upper part of a wall near the ceiling and hooks slidably mounted in the rail from which the exhibits are hung.

If the suspension rail is secured to the wall before the wall is finished, no problems would occur. However, it is difficult to mount the rail to the wall if the wall is already finished, and in a way in which good finish work of the wall can be maintained. In order to overcome such difficulties, a device was proposed by the applicant in Japanese Utility Model Application No. 60-139079 (Japanese Unexamined Utility Model Publication No. 62-46057). An arrangement for hanging exhibits disclosed in this application includes a device for mounting a rail comprising, as shown in FIG. 4, a rectangular base plate 30 having a uniform thickness and a supporting projection 31 having the form of a square tube provided on the front surface of the base plate 30. The base plate is provided with mounting holes 33 at both sides of the projection 31. The supporting projection is provided on its top and bottom surfaces with longitudinally extending ribs 32, 32'. A plurality of such rail fixing members are mounted to the wall at predetermined intervals. The suspension rail is then fitted on the supporting projections 31 so as to engage the ribs 32, 32'.

The rail fixing members in the prior art arrangement constitute a convenient means for securing a suspension rail to an existing wall. But there are the following problems.

When the rail fixing member is secured to the wall by means of screws which are screwed into the wall through the mounting holes 33, it is necessary to use tools at a high location near the ceiling. Thus the tools or a workman's hands are likely to touch the ceiling, making the mounting difficult. Furthermore, although the rail fixing member is made of plastic, some plastic materials are too stiff to be deformed and fitted into the rail.

SUMMARY OF THE INVENTION

An object of the present invention is to provide a device for mounting a rail which obviates the above-described problems.

The device for fixing the suspension rail in accordance with the present invention has the following advantages:

screws 24 can be screwed obliquely into the wall with the tips thereof pointing slightly upward because the mounting holes 9 are formed in the tapered front surfaces 8 of the base plate 6. This provides enough clearance between the ceiling 23 and the mounting tool, making the mounting easier;

a slit 11 is formed in the projection 7, spaced from the center, and the portion between the slit 11 and the top or bottom surface (in this embodiment, the bottom surface) serves as an elastic body 17 which elastically bends when the suspension rail 1 is fitted on the supporting projection 7, facilitating the engagement therebetween; and since the groove 13 formed in the front face of the supporting projection 7 has a shape that is complementary with the shape of the joint ribs 18 in the suspension rail 1, the supporting projection 7 can be deeply inserted into the groove 12 to hold the rail 1 tight.

BRIEF DESCRIPTION OF THE DRAWINGS

Other features and objects of the present invention will become apparent from the following description taken with reference to the accompanying drawings, in which.

DETAILED DESCRIPTION OF THE PREFERRED EMBODIMENT

Figure 1:
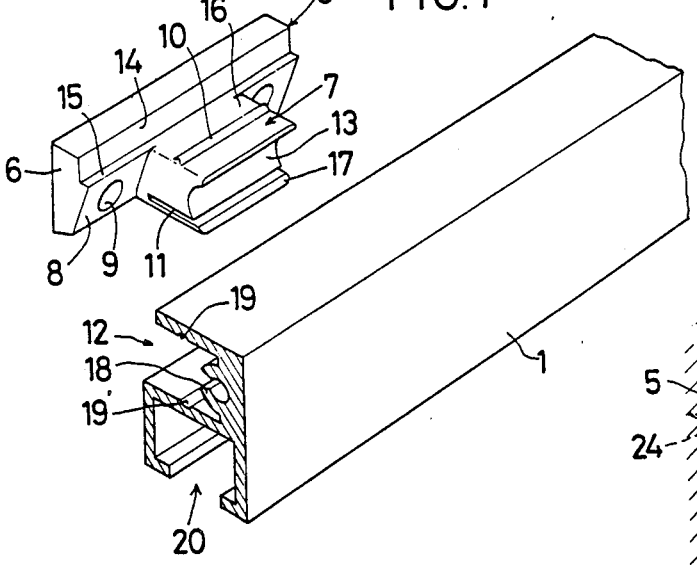
FIG. 1 is an exploded perspective sectional view of an embodiment in accordance with the present invention.

Referring first to FIG. 1, a rail fixing member 5 made of plastic such as polypropyrene by solid molding comprises a generally flat rectangular base plate 6 and a supporting projection 7 integrally formed on the front side of the base plate 6.

An upper front face 14 of the base plate 6 extends parallel to the back of the base plate. A forwardly protruding stepped portion 15 is formed below the upper front face 14. The supporting projection 7 has its upper surface 16 flush with the stepped portion 15 and extends from the midportion of the base plate 6, which is formed with inclined surfaces 8 on its front face at both sides of the projection 7 in such a manner that the thickness of the base plate 6 gradually tapers downwardly from the stepped portion 15. The inclined surfaces 8 form an angle of about 15 degrees with respect to the back of the base plate 6 and are each formed with a vertically elongated eliptical mounting hole 9.

The supporting projection 7 is provided on its top and bottom surfaces with ribs 10, 10' for engagement extending longitudinally along the base plate 6, and has a slit 11 extending therein from its front face adjacent to its bottom and in a direction parallel to its bottom. The portion defined by the slit 11 and the bottom surface serves as an elastic body 17.

The supporting projection 7 has a groove 13 formed in its front face, the bottom of which is curved so as to accommodate joint ribs 18 extending in a groove 12 of a suspension rail 1.

Figure 2:
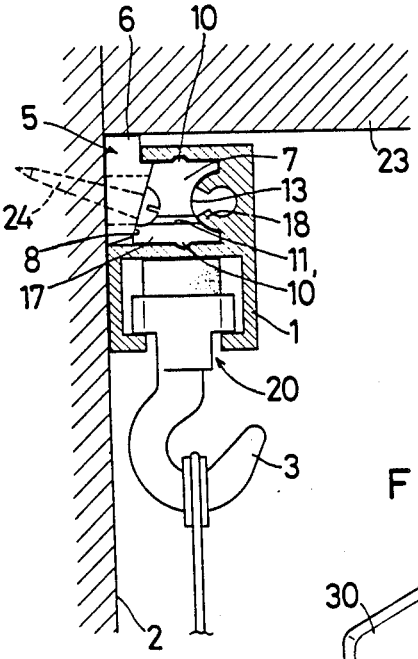
FIG. 2 is an enlarged sectional view of the same.
Figure 3:
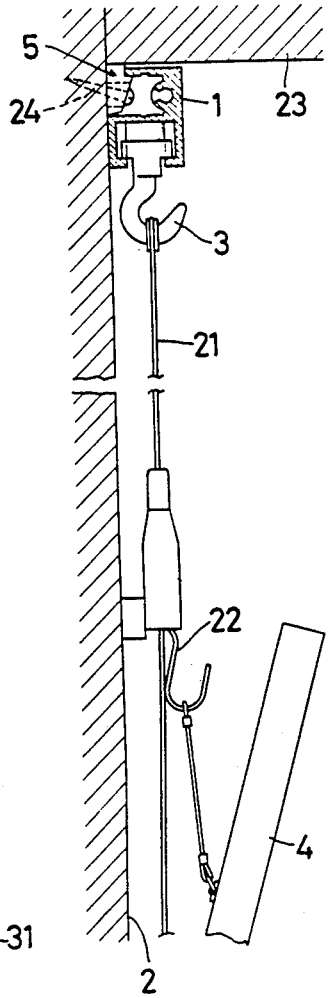
FIG. 3 is a vertical sectional side view of the same with an exhibit hung therefrom.
Figure 4:
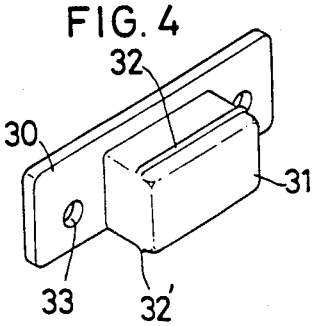
FIG. 4 is a perspective view of a prior art fixing device.

The engaging groove 12 in the suspension rail 1 is open to a wall surface, has grooves 19, 19' open to and opposite inner surfaces defining the groove 12, the grooves 19, 19' adapted to engage the ribs 10, 10', respectively. The suspension rail 1 also has a rail groove 20 extending below the groove 12 with to receive the base of hooks 3 (FIG. 2). Around the hook 3 is passed a wire 21 having a hanger hook 22 secured to the lower end thereof to hang an exhibit 4 such as a painting.

The fixing member 5 is secured to the wall surface 2 near the ceiling 23 by means of screws 24. Since the screws 24 can be screwed into the wall at a right angle with respect to the inclined surface 8, a sufficient clearance for work is left between the ceiling and the tool, making the mounting easier.

In order to make the mounting of the fixing member 5 easier and more efficient, a double-sided adhesive tape may be stuck on the back of the base plate 6 to temporarily attach the fixing member 5 on the wall before mounting the fixing member to the wall with the screws 24.

After a predetermined number of fixing members 5 are mounted on the wall at desired intervals, the suspension rail 1 is pushed hard toward the supporting projection 7 so that groove 12 will engage it, bending the elastic body 17 until the ribs 10, 10' engage the grooves 19, 19'.

With the suspension rail 1 mounted on the fixing members 5, the joint ribs 18 engage snugly the supporting projection 7 in the groove 13 in the front face of the supporting projection 7 as shown in FIG. 2.

What I claim is:

1. A device for mounting a suspension rail for hanging exhibits to a wall, and comprising: a suspension rail having a groove extending therein and a rib means projecting in the groove, said device comprising:

a base plate securable to the wall, said base plate having a top, a bottom, a back surface for abutting the wall and a front surface facing away from the wall when said back surface abuts the wall, said front surface including a pair of inclined surfaces each of which is inclined toward the wall with respect to a direction extending from the top of the base plate to the bottom of the base plate when the back surface abuts the wall, the base plate having a respective mounting hole extending therethrough at each of said inclined surfaces and through which fasteners for securing the device to the wall may extend in an upwardly pointing direction, an upper front face surface, and a stepped portion extending between said upper front surface and said inclined surfaces for supporting the suspension rail; and a supporting projection integral with said base plate and extending from said front face between the inclined surfaces thereof and extending into the groove of the suspension rail to engage the suspension rail, said supporting projection having a top surface, a bottom surface, a respective rib projecting from each of said top and said bottom surfaces of the supporting projection and engaging the suspension rail, and a front surface, the front surface of the supporting projection having a groove extending therealong having a cross section complimentary to the shape of the rib means of the suspension rail and receiving the rib means of the suspension rail, and a slit extending therein across the entire width of the supporting projection, said slit extending adjacent either of said top and said bottom surfaces of the supporting projection, an elastic body portion of the supporting projection defined between said slit and said either of said top and said bottom surfaces, said elastic body portion being resilient for resiliently engaging the suspension rail as the supporting projection is received in the groove of the suspension rail to urge each said rib of the supporting projection into engagement with the suspension rail.

* * * * *